United States Patent [19]

Jolliff et al.

[11] Patent Number: 4,854,590

[45] Date of Patent: Aug. 8, 1989

[54] CASH REGISTER GAMING DEVICE

[75] Inventors: Daniel Jolliff, Moore; Michael W. Hahn, Oklahoma City; Dean C. Oldham, Moore, all of Okla.

[73] Assignee: Continental Brokers and Consultants, Inc., Moore, Okla.

[21] Appl. No.: 47,939

[22] Filed: May 8, 1987

[51] Int. Cl.[4] ..... A63B 71/00

[52] U.S. Cl. ..... 273/138 A

[58] Field of Search ..... 273/138 A

[56] References Cited

U.S. PATENT DOCUMENTS

| | | | |
|---|---|---|---|
| 2,044,320 | 6/1936 | Norris | 273/138 A |
| 3,852,576 | 12/1974 | Rudd | 273/138 A X |
| 4,013,157 | 3/1977 | Britz et al. | 273/138 A X |
| 4,213,524 | 7/1980 | Miyashita et al. | 194/242 X |
| 4,494,197 | 1/1985 | Troy et al. | 273/274 X |
| 4,573,954 | 3/1986 | Berger et al. | 273/138 A |
| 4,669,730 | 6/1987 | Small | 273/138 A |

FOREIGN PATENT DOCUMENTS

| | | | |
|---|---|---|---|
| 1520739 | 8/1978 | United Kingdom | 273/138 A |
| 2123702 | 2/1984 | United Kingdom | 273/138 A |

*Primary Examiner*—William L. Freeh

*Attorney, Agent, or Firm*—Laney, Dougherty, Hessin & Beavers

[57] ABSTRACT

A microprocessor gaming device for use in combination with a cash register which makes a random selection of prize or no prize conditions upon each actuation of the cash register, and which includes a visual display showing prize or no prize selection for each transaction as well as a printer assembly which may be periodically actuated to print out retrievably stored data in the form of a record of all winning and losing indications including prize value for a predetermined accounting period.

11 Claims, 4 Drawing Sheets

CASH REGISTER GAMING DEVICE

BACKGROUND OF THE INVENTION

1. Field of the Invention

The invention relates to random actuation gaming devices for use in combination with cash registers in mercantile establishments and, more particularly, but not by way of limitation, it relates to programmed microprocessor circuitry functioning in co-action with a cash register to provide random prize selection that is announced and displayed in characteristic manner.

2. Prior Art

The prior art includes a number of teachings wherein some form of gaming device is used in combination with a sales related device such as a cash register. The basic object, of course, is to increase sales through participation in an ancillary game that may provide a reward. U.S. Pat. No. 2,927,201 teaches a chance device for attachment to a gasoline pump. A chance display is exhibited on a random rotated wheel and the entire assembly is solenoid actuated in response to gas pump operation. U.S. Pat. No. 3,129,004 teaches a chance device for use in combination with a cash register wherein the device is actuated by movement of the cash drawer to initiate rotation of a plurality of characters, i.e. mechanical gaming wheels. This is on the order of the traditional slot machine where stopping of the characters in a predetermined formation can be used to designate cash or goods prize awards.

U.S. Pat. No. 3,091,388 discloses a random light switching apparatus that is actuated in response to cash drawer opening. This device is actually intended for encouragement of public supervision of the cash register during transactions thereby to guard against "no sale" ringups and other pilferage techniques by the attendant. U.S. Pat. No. 3,468,476 teaches still another form of solenoid actuated mechanical wheel device of the slot machine type. Finally, U.S. Pat. No. 4,501,422 provides teaching of a microprocessor circuit functioning in conjunction with a beer tap switch to produce two randomly changing multiple light columns. An operation may be given switch control of a gaming function wherein the lights can be stopped in predetermined relationship to give prize awards.

SUMMARY OF THE INVENTION

The present invention relates to a cash register gaming device utilizing programmed microprocessor circuitry which provides a plurality of gaming functions with display as well as a time coordinated accounting of prizes awarded within a predetermined period. The device is actuated by a switch closure or selected input from an associated cash register functioning in co-action therewith. The gaming device includes a central processing unit including program and data storage for effecting gaming operations, including random number generation, prize selection and/or random light operation, for subsequent energization of a customer display and/or audio output system. The program of the system functions to maintain a total accounting of system functions over a predetermined period of time, e.g. an operating month, and this data is available for print out so that the business operator can be apprised of his prize award status for the time period.

Therefore, it is an object of the invention to provide a sales incentive gaming device.

It is also an object of the present invention to provide a cash register gaming device that enables the operator to have full knowledge of the effectiveness of the device at any given time.

It is yet another object of the invention to provide a device for concentrating attention on cash register operation thereby to avoid pilferage or other unusual cash handling practices.

Finally, it is an object of this invention to provide a cash sales gaming device that is entertaining and inoffensive to the purchasing public while also totally controlled as to frequency of gaming awards within a predetermined time period.

Other objects and advantages of the invention will be evident from the following detailed description when read in conjunction with the accompanying drawings which illustrate the invention.

DETAILED DESCRIPTION OF THE INVENTION

Figure 1:
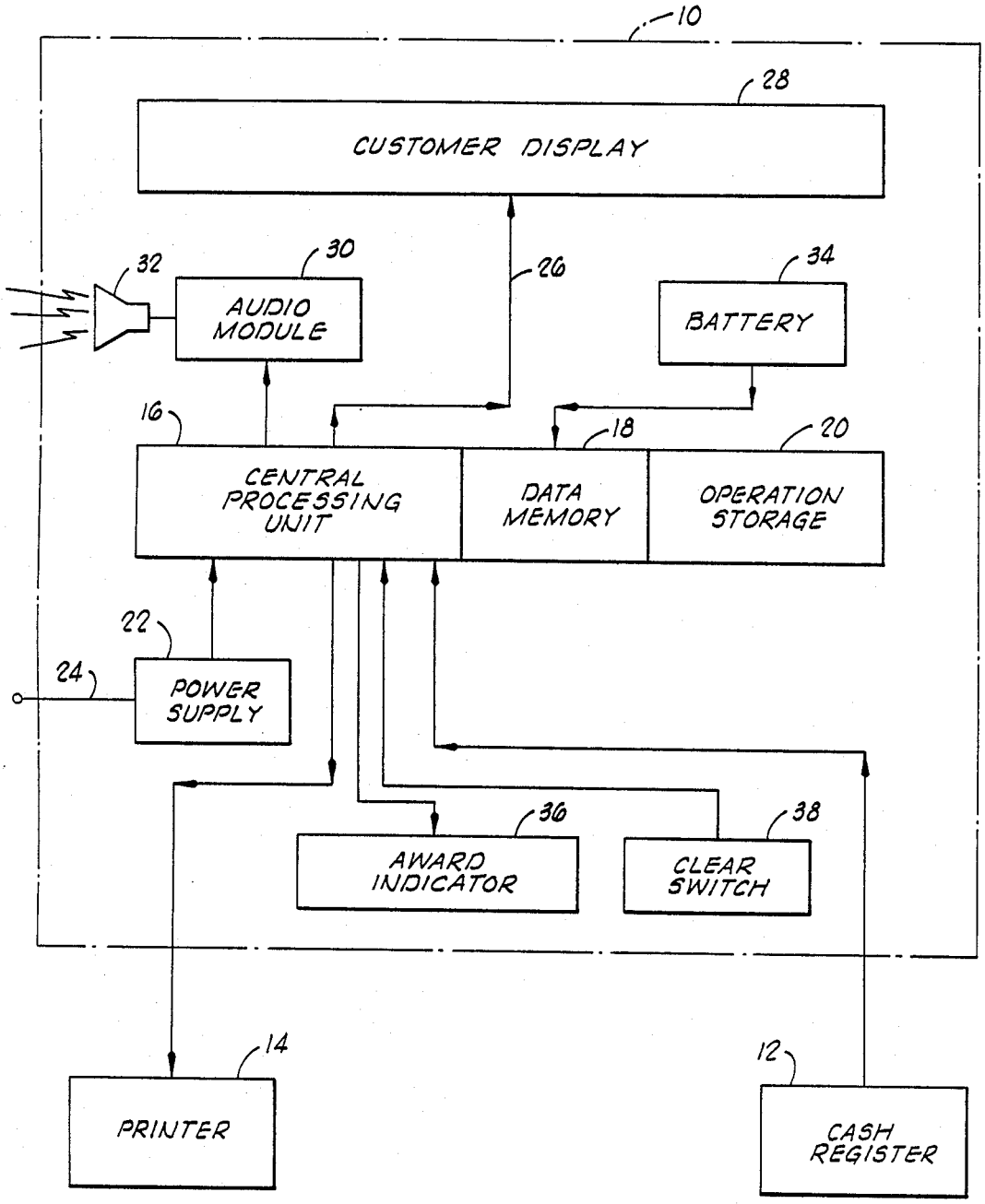
FIG. 1 is a functional block diagram illustrating the basic operation of the invention.

Referring to FIG. 1, a gaming device 10 is operatively connected to a cash register 12 to provide a coactive prize award function. A printer assembly 14 maintains a continual tally of the operation of gaming device 10 in terms of time versus prizes awarded and the degrees of prizes awarded, as will be further described.

Gaming device 10 includes a central processing unit 16, a conventional microprocessor circuit as will be further described, functioning with a data memory 18 and suitable operation storage 20 for containing all requisite program data. The system is energized by suitable power supply 22 and main power input 24, which may be supplied from cash register 12. The central processing unit 16 provides visual output via line 26 to a multidigit customer display 28. Audio output may be provided from central processing unit 16 via audio module 30 and an associated speaker 32.

A D-C battery 34 is connected to data memory 18 to provide keep-alive voltage to the integrated chip storage cells in the event of a power failure. Thus, basic operating instructions as well as time coordinated accounting data will not be lost. A back panel award indicator 36 maintains operator awareness of the prize situation and a clear switch 38 is available for the operator to reset the system after each prize award.

The gaming device 10 is mountable on the top of a cash register with the display 28 located above the cash register display. Suitable advertising display or logo may be located on the front adjacent to display 28. Mounting brackets are provided with the gaming device that are adjustable for fitting to various styles of cash register, and an interface plug is provided that will accomodate the various designs of cash register input plug. Keyed switches for operator control may be located on the rear panel. A real time cock, as will be further described, is incorporated for use in developing daily, monthly, and yearly totals, and also for resetting monthly prize awards to insure the guaranteed number of prizes will be awarded per unit time.

Figure 2:
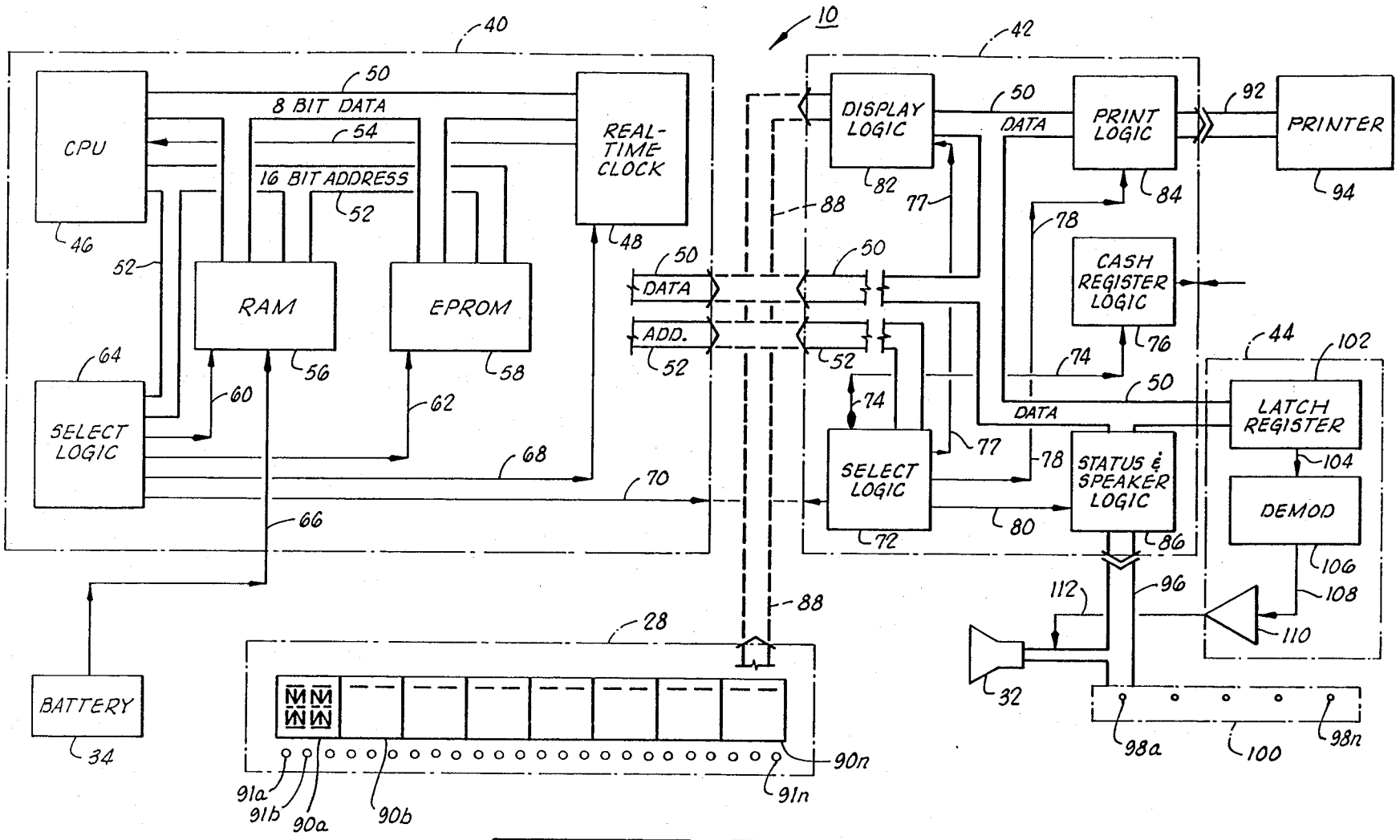
FIG. 2 is a block diagram illustrating the electronic circuitry of the gaming device.

Referring to FIG. 2, the device 10 consists of a microprocessor board 40 interconnected with an input/output driver board 42 and a talker board 44. A CPU 46 consists of a microprocessor integrated circuit type Z80A functioning in interaction with a type Z80CTC integrated circuit chip 48. The CPU 46 functions into an eight bit data buss 50 and a sixteen bit address buss 52. Interrupt clock pulses are applied on lead 54 to CPU 46. A random access memory 56, type HM6264, and an erasable programmable read only memory, IC type 27256, are connected in parallel to each of the data buss 50 and address buss 52. The RAM 56 and EPROM 58 are controlled by select pulses available on respective leads 60 and 62 from select logic circuitry 64. Keep-alive D-C voltage is continually maintained from a suitable D-C source or power back-up battery 34 via lead 66.

The select logic circuit 64, a decoder IC type 74LS139, provides a RAM select pulse on lead 60 and an EPROM select pulse output on lead 62, while a CTC select pulse is output on lead 68 to the real time clock 48. A further input/output select pulse is output on lead 70 to a select logic circuit 72 on the driver board 42. The data buss 50 and address buss 52 are also interconnected with the input/output driver board 42.

The select logic circuit 72, an IC type 74LS138, is responsive to the address buss 52 to provide a plurality of enabling outputs. Thus, logic circuit 72 interfaces on line 74 with a cash register logic array 76 which is connected to the external cash register 12 (FIG. 1). Also, select pulse outputs on leads 77, 78 and 80 function to control the display, the print out and the status and audio functions through respective display logic 82, print logic 84 and status and speaker logic circuit 86, consisting of IC type 74LS245.

The cash register logic circuitry 76 is interconnected to the cash register and receives electrical input indicative of cash drawer position, "no sale" key strobe, "no sale" key return, primary power failure and system ground. The cash register logic 76 functions to initialize the CPU 46 for each gaming function. The display logic 82 receives input of data buss 50 and includes integrated circuit decoder and driver circuitry for providing output via control buss 88 to control energization of each of dual digit LED indicators 90*a*, 90*b*–90*n*. In present design, there are eight such dual digit indicators 90 controlled in banks of four with two digits each. Thus, the display consists of sixteen digits of fourteen segments each to provide alphanumeric capability.

The print logic circuit 84 is also connected to data buss 50 and responsive to the strobe or select pulse on lead 78 to provide an eight bit output on buss 92 to control the printer 94. The printer 94 may be such as a SEIKO I & E microthermal printer, Model EPU-40, as commercially available from SEIKO Instruments, U.S.A., Inc., Torrance, Calif. The print logic 84 may utilize essentially a printer Driver IC type 74LS245 which processes the input from data buss 50 to provide eight bit output on printer buss 92.

A similar type of integrated circuit may be utilized in the logic circuit 86, also connected to data buss 50, which provides an output via buss 96 both to energize the speaker 32 in response to a prize award and to energize a selected status lamp 98 on status panel 100. Status panel 100 is displayed for operator recognition only so that the cash register attendant is continually apprised of the game status.

Still another audio function is provided by the talker board 44 which includes an eight bit latch and register circuit 102 that is responsive to voice message code on the data buss 50 to generate a frequency modulated voice data output of preselected duration. The FM data output in serial array on lead 104 is then applied through a demodulator 106 to produce an amplitude modulated output on lead 108. The AM signal on lead 108 is then suitably filtered and amplified in an amplifier 110 for output via lead 112 to speaker 32.

Figure 3:
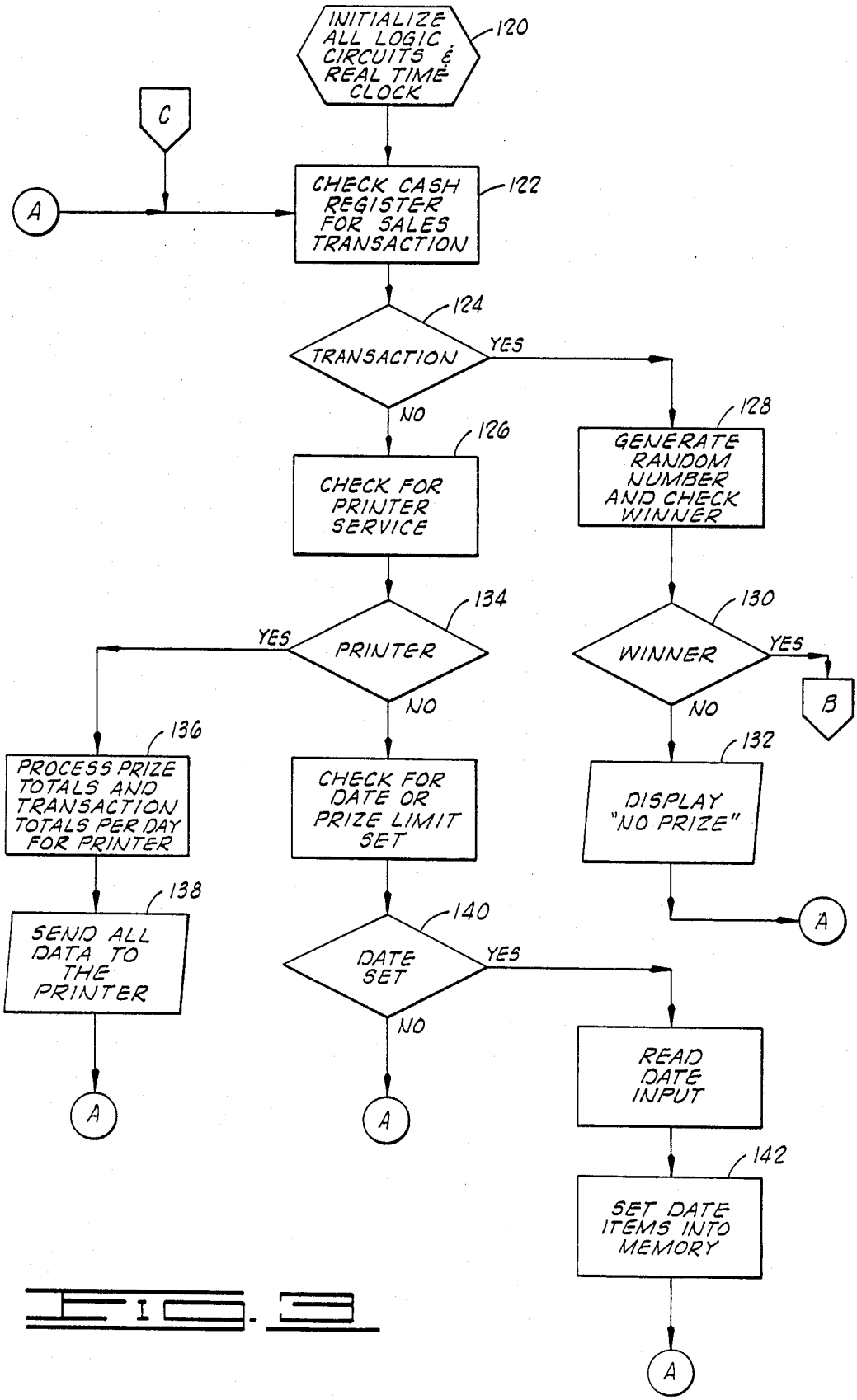
FIG. 3 is a flow diagram illustrating a portion of the program operation of the gaming device.
Figure 4:
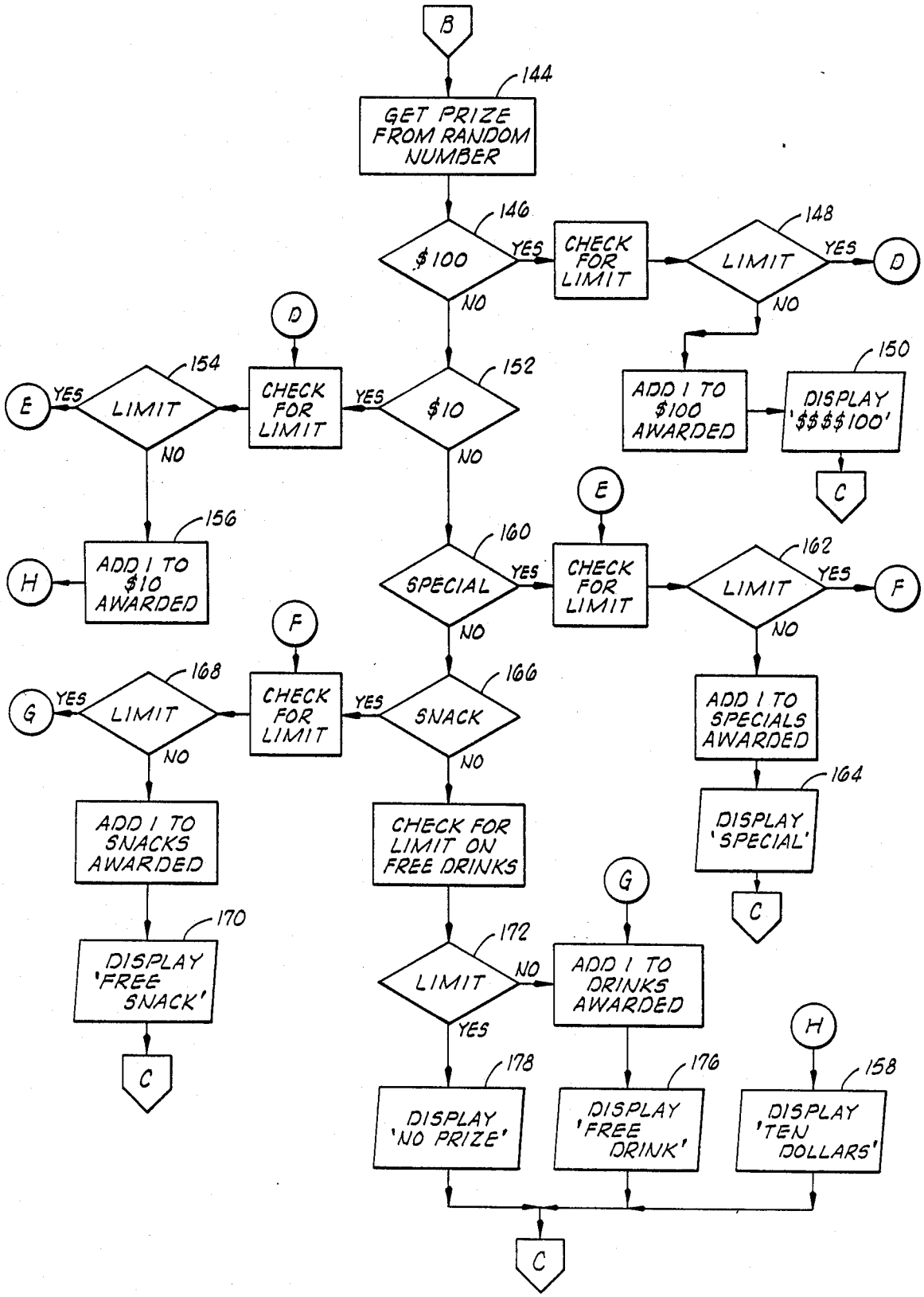
FIG. 4 is a flow diagram of the remainder of the program operation of the present invention.

FIGS. 3 and 4 illustrate the functional flow diagram as controlled by the program in gaming device 10. All logic circuits and the clock are initialized at stage 120 whereupon a series of check stages begin. Stage 122 checks the cash register for a present transaction through a decision stage 124 and, if none, the flow proceeds to check for printer service at stage 126. If affirmative, flow moves to function stage 128 for generation of a random number and checking for a winner.

Random number selection is carried out by selection of groups of numbers within a 32,000 number base. Five different groups of numbers of varying size or number of numbers, are designated as winner groups, and these five categories may designate prizes of, for example, $100.00, $10.00, special prize, snack, and drink. A much larger segment of the total of numbers will remain representative of "no prize" positions. If, in fact, the number generated in stage 128 is a designated winner number, then flow proceeds to a query or decision stage 130 which gives an affirmative answer and transfers to routine B (FIG. 4). The routines and branching under input B function variously to determine the size of prize award and check for award limits within the designated customer time period.

Returning to FIG. 3, if no winner is detected at stage 130, then flow stage 132 actuates a "no prize" display designation and flow proceeds to input A to enable the cash register for the next subsequent sales transaction.

Returning to decision stage 124, a negative test check for printer service proceeds to decision stage 134 and a printer decision affirmative actuates the printer as at stage 136 to process prize totals and all transaction totals for the day. The stage 138 then functions to print out all data and return process flow to input A. A negative output from decision stage 134 checks for data for prize limit to see that all update is correct and, if affirmative at stage 140, then all data items are committed to memory at stage 142 with return to input A.

Referring to FIG. 4, an affirmative winner input from decision stage 130 (FIG. 3) is applied at input B and is determined at stage 144 as to the particular prize per selected random number. If the $100.00 prize is selected, that is decision stage 146 tests affirmative, then the system is checked for limit as to whether or not there are any $100.00 prizes left for the unit time, e.g. the operating month. If the limit has not been exceeded, as tested at decision stage 148, then flow proceeds through stage 150 to pay out and display the $100.00 symbols with return to input C (FIG. 3). If the $100.00 decision stage 146 tests negative then flow proceeds to the $10.00 decision stage 152. If affirmative, the program checks for limit at stage 154 and if limit has not been exceeded, it adds one to the $10.00 talley at stage 156 and proceeds to input H and display control of the $10.00 symbols at stage 158. If the limit has been exceeded at $10.00 limit stage 154, an affirmative output proceeds to input at E for consideration of the next lower prize.

A negative output from $10.00 decision stage 152 proceeds to the "special" award decision stage 160 and, if affirmative, then a check for limit will proceed to limit stage 162 to determine whether or not there is a "special" award yet to be given in the allotted prizes for the unit time. If yes, proceed to input F, but if the limit has not been exceeded, then branching through award and display stage 164 may proceed with return to input C.

If decision stage 160 tests negative then a "snack" prize shows affirmative then there is a check for exceeding the "snack" limit with testing in decision stage 168; and, if the limit has not been exceeded there is talley and subsequent free "snack" display as shown at stage 170. If the limit has been exceeded then flow proceeds to input G and the possibility of being awarded a "drink" or the lowest prize in the array.

Thus, should the snack decision stage 166 show negative, then the player's chances descend still further to a check for a limit on free drinks in decision stage 172. If not, the system tallies one free "drink" award and displays the requisite symbols with return to initializing input C (FIG. 3). Should limit 172 show excession then flow stage 178 activates "no prize" display with return to initializing input C.

The gaming device 10 is designed for use in combination with business cash registers to induce not only sales enhancement but also to augment the patron's cognizance of cash register activity thereby to induce accurate accounting and minimal pilferage. Thus, a patron's participation in the game of chance can only be activated through a positive sale cash register ring-up, a "no sale" ring-up will not enable participation. In initial designs, the gaming device 10 has been identified under the mark "LUCKY DUCK" as a trade identifier and certain operational references hereinafter may be with reference to the "LUCKY DUCK" game as used in conjunction with cash registers in places of business, e.g. convenience stores, gasoline stations, fast food shoppes and the like.

When a transaction takes place, and a proper ring is made on the cash register, a random number is generated to determine if a prize will be awarded. As discussed relative to FIG. 4, the prizes are in five categories; $100.00, $10.00, Special, Snack, and Drink. This is merely a function of the particular program, however, and the size and number of prizes are readily programmable to meet whatever the exigencies of the particular installation.

As shown in FIG. 3, the program initializes the real time clock and all select logic, and thereafter checks for transactions, printer service, and/or date set. If a particular service is needed, then the program branches to that routine. When a sales transaction has been made, a random number is generated as at flow stage 128 and a prize category is selected by the particular random number. If a winner is indicated at decision stage 130, the program branches to input B (FIG. 4) and the prize category is tested to determine the amount or type of prize to be awarded. If a prize is determined to have reached its limit for the particular month or unit accounting period, then the next lower prize category will be tested. This process continues until all prizes have been awarded for the month. At the beginning of each month then all prize awards will be zeroed and the process will be reenabled.

Programming on a monthly basis or other unit time period is responsive to a real time clock operating in synchronism with the software, and the real time clock will keep track of the day, month, year, as well as leap years. All transactions are tallied on a daily basis with each prize category also totaled on a daily basis for subsequent monthly reporting.

Printer service routines will automatically be called whenever a printer 94 (FIG. 2) is connected into the system. Thus, a service attendant at his periodic call time connects his printer 94 and sets all of the unit time accounting procedures into motion. The printout may include all transactions and each prize category as tallied for each day on a month-to-day basis or other unit accounting time. The date set is activated via printer connection and the program includes a date routine which allows for date entry, time entry and update of the real time clock. In the event of a power failure, the back-up power or D-C battery 34 assures that date, time and data will not be lost.

The LUCKY DUCK gaming device retains all prize and statistical data in the RAM 56, and program control to the printer has the ability to print the previous 100 days of prize and statistics data. The device 10 also has the ability to calculate the win/lose odds based upon customer volume and prizes to be awarded in the current month, whatever the hours remaining in the current month. This ratio relationship also allows the device to calculate correct odds and prizes remaining when the gaming device 10 is installed in a mid-month accounting period.

The display 28 includes eight dual digit alphanumeric display chips 90*a–n* as well as a plurality 91*a*–91*n* LED indicators which may be controlled to flash in various synchronous relationships. A rear display 100 has a set of 5 LED indicators which are directed towards the clerk station so that he is cognizant of prizes won and the general operation of the equipment. There is also a reset button at the clerk's station which allows reset of the gaming device 10 once a prize has been awarded. This assures that the clerk is also participating and aware of a prize won as play can only recommence after reset. There may also be a customer button accessible near the front of the cash register which enables the LUCKY DUCK device to play the game only after the customer presses his button, this demanding complete customer attention and participation.

At present, the game device 10 is programmed to carry out three display modes as regards the light displays, i.e., blinking, walking across the screen, and walking a predetermined display or letter combination onto the screen and then blinking the display. The program enables display output of some 20–30 messages from the changeable tables such as "free drink", "No Duck Luck", "IOU", "Winner—Winner" and the like. The device is capable of still other variable length messages that may be directed as desired to state such as "Win Snacks", "Win Free Prizes ", "We appreciate your businesss", etc.

Still other capabilities are programmed into the device as the game device can reproduce a roulette wheel motion and sound for added gaming effect. The program also allows custom display and talking data to be reproducible in accordance with the standard program code. A plurality of maintenance switch outputs may be utilized to allow on site programming of the number of individual prize types, quantities and related information. Such additional custom programming is also under the control of the periodic collection attendant.

Changes may be made in combination and arrangement of elements as heretofore set forth in the specification and shown in the drawings; it being understood that changes may be made in the embodiments disclosed without departing from the spirit and scope of the invention as defined in the following claims.

The embodiments of the invention in which an exclusive property or privilege is claimed are as follows:

1. A gaming device for use in combination with a cash register comprising:

interface means conducting an actuation input from said cash register upon ring-up of a valid sale function;

computing means connected to said interface means and functioning in real time, said computing means being programmed to commence gaming operation upon receiving said actuation input to generate a selected indication from a predetermined group of indications which include a plurality of winning indications of differing prize value and a plurality of losing indications and to store retrievably said indications;

display means controlled by said computing means to convey notice selectively proximate the cash register of all such winning and losing selected indications; and means including a printer for querying said computer means periodically to retrieve the stored indications and for printing out a record of all winning and losing indications including prize value for a predetermined period preceding the query.

2. A device as set forth in claim 1 wherein said display means comprises:

a multi-digit alphanumeric display affixed in association with said cash register.

3. A device as set forth in claim 1 wherein said display means comprises:

a display board having a plurality of aligned alphanumeric digital indicators connected for viewing adjacent said cash register.

4. A device as set forth in claim 3 which is further characterized to include:

a plurality of aligned individual lamp devices arrayed on said display means wherein said individual lamp devices can be energized sequentially in predetermined timing relationship to provide a repetitively cycling illumination.

5. A device as set forth in claim 1 wherein said computing means comprises:

microprocessor means functioning under a predetermined program control;

storage means interconnected through a data buss and address buss to said microprocessor means; and input/output logic means receiving input of said data buss and address buss to provide output control to said display means and means including a printer.

6. A device as set forth in claim 5 wherein said display means comprises:

a mulit-digit alphanumeric display affixed in association with said cash register.

7. A device as set forth in claim 5 which further includes:

select logic means connected to said address buss and operative to output time control pulses to said storage means and to said input/output logic means.

8. A device as set forth in claim 5 wherein said input/output logic means comprises:

logic means interconnected with said address buss and responsive to said computer means to generate a plurality of timing control pulses;

display logic connected to said data buss and actuated by one of said timing control pulses to control said display;

a print logic circuit connected to said data buss and controlled by one of said timing control pulses to provide data output to said means including a printer;

status and speaker logic means connected to said data buss and controlled by a timing control pulse to provide an audio code output; and audio means controlled by said status and speaker logic to provide audible output.

9. A device as set forth in claim 5 wherein said microprocessor means further comprises:

random access memory means which functions as scratch pad storage with said microprocessor means;

erasable programmable read only memory functioning with the microprocessor means and providing storage for the system control program.

10. A device as set forth in claim 9 wherein said display means comprises:

a multi-digit alphanumeric display affixed in association with said cash register.

11. In a gaming device that utilizes a programmed digital computer and functions in coaction with a cash register for actuation to generate a chance indication for prize award, the programmed method of operation comprising:

assigning a plurality of prizes of varying levels of reward to selected ones of a set of numbers;

limiting the number of prizes available for each level of reward over a predetermined unit period;

actuating the gaming device in response to each cash register transaction to generate a random number;

comparing said random number with the set of numbers to determine one of a losing number, a winning number and prize award;

checking to determine if the particular prize award is still available for the level of award in the unit period; and visually displaying the prize adjacent the cash register.

* * * * *

UNITED STATES PATENT AND TRADEMARK OFFICE

CERTIFICATE OF CORRECTION

PATENT NO. : 4,854,590

DATED : August 8, 1989

INVENTOR(S) : Daniel Jolliff, Michael W. Hahn and Dean C. Oldham

It is certified that error appears in the above-identified patent and that said Letters Patent is hereby corrected as shown below:

In Column 5, line 13, before "prize" add --decision stage 166 is queried. Here again, if the "snack"--.

Signed and Sealed this

Fifteenth Day of May, 1990

*Attest:*

HARRY F. MANBECK, JR.

*Attesting Officer*

*Commissioner of Patents and Trademarks*